United States Patent [19]

Bloom et al.

[11] 4,338,351

[45] Jul. 6, 1982

[54] APPARATUS AND METHOD FOR PRODUCING UNIFORM FIRED RESISTORS

[75] Inventors: Terry R. Bloom, Middlebury; Marion E. Ellis, Decatur, both of Ind.

[73] Assignee: CTS Corporation, Elkhart, Ind.

[21] Appl. No.: 185,757

[22] Filed: Sep. 10, 1980

[51] Int. Cl.[3] ..... H01C 17/06

[52] U.S. Cl. ..... 427/8; 29/620; 427/9; 427/10; 427/101; 427/102

[58] Field of Search ..... 427/101, 102, 8–10; 29/620

[56] References Cited

U.S. PATENT DOCUMENTS

| | | | |
|---|---|---|---|
| 2,273,941 | 2/1942 | Dorn | 427/10 |
| 3,414,641 | 12/1968 | Miller | 264/61 |
| 3,464,351 | 9/1969 | De Hart et al. | 101/126 |
| 3,476,906 | 11/1969 | Rovan | 219/121 |
| 3,619,287 | 11/1971 | Stankavich | 117/227 |
| 3,699,650 | 10/1972 | Cocca | 29/620 |
| 3,775,278 | 11/1973 | Hensler | 204/192 |
| 3,998,980 | 12/1976 | Antes | 427/103 |
| 4,137,519 | 1/1979 | Hodge | 427/102 |

OTHER PUBLICATIONS

Sergent et al., "Design Method for Thick Film Resistors", *Solid State Technology,* Oct. 1977, pp. 63–67.

Mones et al., "Combination Glaze Resistor", *IBM TDB,* vol. 8, No. 5, Oct. 1965, pp. 735–736.

*Primary Examiner*—John D. Smith

*Attorney, Agent, or Firm*—Larry J. Palguta; John A. Young

[57] ABSTRACT

An apparatus and process for producing fired resistors having uniform resistance characteristics, wherein a continuous closed-loop feedback network detects deviations from standard resistivity values and continuously corrects the composition by varying the proportions of high and low resistance material ratios or blends of such materials being screened onto the substrates (212), and detects deviations in screened-on film thickness for continuously correcting either the speed of operation of a screener assembly (No. 1, No. 2) or the squeegee head pressure in order to obtain a predetermined film thickness. The process continuously adjusts the fired resistance values through on-the-production-line control of mixture ratios of high and low resistive paints, to produce final fired resistors (170) having the required resistance values, temperature coefficients of resistivity, improved stability, and improved TCR tracking values.

21 Claims, 7 Drawing Figures

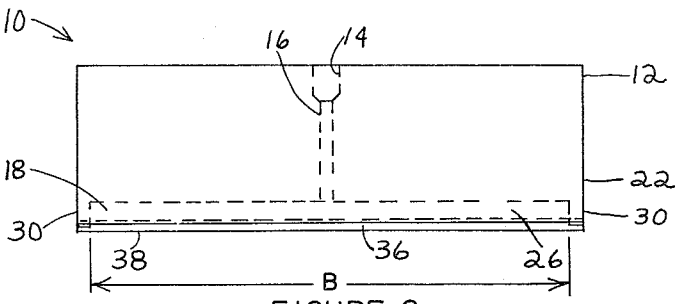
FIGURE 1
FIGURE 2
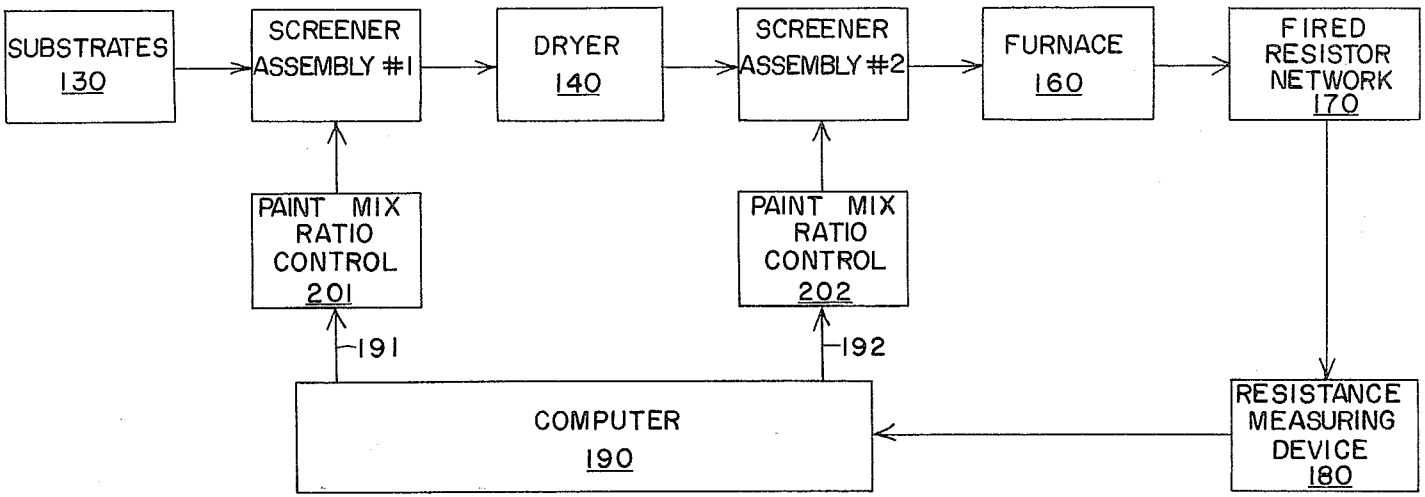
FIGURE 6

APPARATUS AND METHOD FOR PRODUCING UNIFORM FIRED RESISTORS

DESCRIPTION

1. Technical Field

This invention relates to the manufacture of resistors networks. More particularly, it relates to the screening of resistive paste mixtures onto ceramic substrates for subsequent firing to produce fired resistors on the substrates. It is essential that specific fired resistance values having predictable TCR's and TCR tracking values be producible by this process, and that the manufacturing process be readily convertible for the application of different resistive paint mixtures.

2. Background Art

The De Hart et al. U.S. Pat. No. 3,464,351, issued on Sept. 2, 1969, describes a circuit screening machine wherein resistive material or paint contained within the pressurized piston of a cylinder is supplied to a squeegee. The squeegee then wipes the paste onto a screen, the paste passing through the open pattern of the screen and being deposited on substrates. The substrates are positioned one-at-a-time into printing position by hand, and for a change of job, all the parts in contact with ink must be removed and replaced.

The De Hart patent and other prior art devices have lead to the development of automatic screening machines wherein the substrates are fed automatically to the machine, the resistance material is screened onto the substrate as a thick film, and then the film is fired. In order to obtain specified resistance values having known temperature coefficients of resistivity and temperature coefficient of resistivity tracking values, premixed resistive pastes have been utilized according to the specifications of the purchaser. However, the prior art has not overcome several problems in this field. First, changes in resistive paint mixtures must be done off-line i.e., that is the pastes are mixed and placed into containers, the mixture containers are stored, then a particular mixture is used for screening an order, and the leftover or remaining paste mixture is stored until another order requiring that particular mixture is received. The paste mixtures are kept in store rooms where they are subject to a limited shelf life and subsequently discarded when deterioration has occurred. Additionally, premixed paint blends at fixed paint ratios must be used and one selected which most nearly meets the specifications of the customer's order.

Second, in the prior art, resistive paste mixtures fed into and through the squeegee and onto the screen, have not been confined to the interior area of the squeegee defined as the area between the wipers of the squeegee. The resistive mixture flows beyond the wipers and some of the resistive paste mixture is wasted because it is not deposited on the substrate but is left on the screen. Squeegees currently in use do not efficiently confine the resistive mixture to an area between the wipers for disposal through the screen onto the substrate and are consequently wasteful.

Third, when a new resistor is screened by the screening machine, the squeegee head, feed tubes, resistive paste container, and other parts as described in the De Hart patent, must be either removed or cleaned, thereby requiring a substantial period of time during which the screening machine is not operating because of the changeover from one resistive paste mixture to another resistive paste mixture. This has a detrimental effect upon the screening machine output capacity.

Fourth, the prior art has attempted to control the uniformity of fired resistors by utilizing feedback controls to control the various firing parameters i.e., time, temperature, and atmosphere. For example, the Allington et. al. U.S. Pat. No. 3,663,276, issued May 16, 1972 discloses a method for adjusting the resistivity of a thick film resistor by determining the relationship between the resistivity of the fired composition and the drying time before the beginning of the firing cycle. The Degenkolb et. al. U.S. Pat. No. 3,793,717, issued on Feb. 26, 1974, discloses a method of compensating for the drift in resistance away from the target resistance value of fixed resistors by controlling and changing either or both peak temperature and belt speed in accordance with a measured relationship between resistivity and time-temperature in the furnace. O'Connell et al., U.S. Pat. No. 3,481,306, issued on Dec. 2, 1969 describes a feedback control circuit controlling a bidirectional method of trimming resistance values by selectively applying oxidizing and reducing atmospheres to one portion of a vitreous enamel film resistor to cause an oxidation reaction to increase the resistance or a reduction reaction to decrease the resistance. State-of-the-art thick film resistance paints have developed to the point that they show very little change on fire or refire and have a relatively low sensitivity to normal furnace variations. Therefore, in order to obtain more closely controlled final fired resistors having a more uniform resistivity, temperature coefficient of resistivity (TCR), and TCR tracking values (TCRTV), the close control of paint raw materials, processing environment, deposition variance, and improved screen wear, are necessary achievements in order to obtain or achieve yields and control fired resistor parameters. Under the current production methods, resistive paints are not mixed on-line in order to control the uniformity of the fired resistor characteristics required by a particular order, and, therefore, feedback control circuitry has not been utilized to effect the appropriate paint mixtures.

DISCLOSURE OF THE INVENTION

In accordance with the present invention, an on-the-line blending of resistive pastes is provided wherein high and low resistive pastes are pumped at independently controllable volumetric rates and mixed to form a blend having the desired resistance. The squeegee-head mixer blends the paste and feeds the mixture through a squeegee mounted thereon to the screen disposed against the squeegee. The squeegee consists of a squeegee body having depending parallel wipers with dams disposed transversely at the ends of the wipers. The wipers each have an inner and an outer face. The faces are disposed at angles so that the resistive mixture will be maintained between the wipers and dams and be restricted from flowing beyond the wipers onto parts of the screen adjacent the pattern. The material will be deposited onto the substrate and will not be wasted. In conjunction with the paint mixing apparatus and novel squeegee, a closed-loop feedback system is provided which reads the thickness values of wet resistance films and the resistance values of the fired resistors, compares the values to standard preselected values, determines the deviations therefrom, and communicates with screener assemblies for adjusting either the speed of the respective screener assembly or the squeegee head pressure of the assembly and with paint mixture ratio controllers which then automatically adjust the ratio of the high and low resistance pastes supplied to the respective squeegee-head mixers. Thus, the closed-loop feedback system continuously monitors both the thickness of screened-on resistance films for effecting either a change in screener assembly speed or squeegee pressure in order to obtain a desired film thickness, and the fired resistance values for effecting changes in the paint mixture ratios in order to obtain more uniform fired resistor characteristics.

The squeegee-head mixer is of particular significance because individual resistive materials consisting of high and low resistive paints, can now be mixed on the production line during production runs according to the specifications and requirements of the customer order. The resistive pastes are pumped by independently adjustable volumetric amounts to the squeegee head-mixer for mixing, and then fed to and through the squeegee for screening onto substrates being fed automatically through the screening machine. Thus, when a different production order is to be run, the resistive paste mixture ratio can be adjusted to a new mixture, and the change-over from the previous order to the new order can be implemented in less than five minutes, thereby resulting in a much shorter down-time for the machine during change over between production runs. Additionally, and of great advantage, is that pre-mixed paint blends will no longer be maintained in storage where they are subject to shelf life deterioration and the uncertainty of future use. This will reduce greatly the amount of resistive paint materials that are wasted through deterioration on the shelf. Of greater significance is the ability to provide the exact paint mixture required for an order, rather than having to select a premixed blend which approximates the specifications of the order. Also, if a resistive material happens to vary from its listed value, adjusment of the pumps can compensate for such a variance.

An additional savings in the amount of paste used by the screening machine, is accomplished by the squeegee which maintains the blended mixture within the area between the parallel wipers and dams, thereby reducing the waste of paste mixtures on areas adjacent the pattern of the screen pattern. This is accomplished by the small passages in the mixing head and squeegee which greatly reduce the amount of paste mixture being fed through the squeegee onto the screen, and by the angles on the inner and outer faces of the wipers which significantly restrict the outward flow of paste mixture by retaining the paste mixture between the wipers and dams. If a greater volume of mixture is required for the screening operation, a speed adjustment may be made on a variable speed motor which commonly drives the pumps supplying the high and low resistance pastes to the squeegee-head mixer. The adjustment of the speed of the motor driving the pumps may be made in conjunction with a change in the speed of a variable speed motor driving the mixing head. Thus, the total volume of the paint mixture being pumped through the mixing head can be increased or decreased without changing the ratio of the individual pastes being blended. Additionally, the pumps supplying the high and low paste materials to the squeegee head mixer are independently controllable so that the blend ratio of a mixture may be changed quite easily by adjusting the flow rate of each of the pumps Finally, the closed-loop feedback system results in the achievement of optimum target values of the blends as a major tool for achieving uniform yields, increased yields, and controlling fired resistor parameters. This is a significant and important improvement in the state-of-the-art control of the various parameters of fired resistors, that is, the resistance value, the temperature coefficient of resistivity (TCR), and the temperature coefficient of resistivity tracking value. The TCR tracking value (TCRTV) may be defined as the ratio of the differences between the changed resistance values of resistors in a resistor network as the ambient and operational temperatures of each resistor varies during operational use, such a change having a distorting effect upon circuitry. It is desirable for the resistors in the network to maintain their ratio one to another despite temperature changes and the passage of time, and thereby maintain the uniformity of the network output.

BRIEF DESCRIPTION OF THE DRAWINGS

FIG. 1 is a side view of the squeegee of the present invention;

FIG. 2 is a front view of the squeegee;

FIG. 6 is a flow diagram showing the components of the closed-loop feedback network; and, FIG. 7 is a flow diagram illustrating the components for monitoring the thickness of wet screened-on films and effecting an adjustment in the respective screener assembly.

BEST MODE FOR CARRYING OUT THE INVENTION

Figure 4:
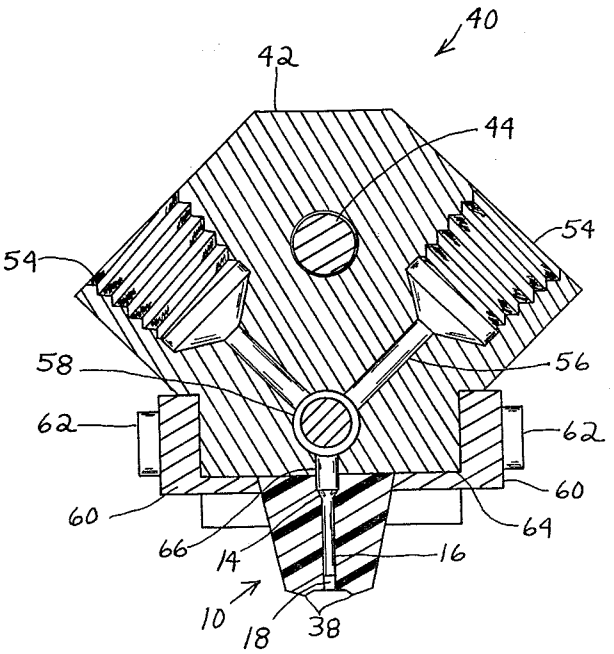
FIG. 4 is a section view along lines 4—4 of FIG. 3.

Referring now to FIGS. 1 and 2, FIG. 1 illustrates a side view of the squeegee of the present invention. The squeegee is designated generally by reference numeral 10, and comprises a squeegee body 12 formed of a polyurethane material. Squeegee body 12 contains feed aperture 14 and feed passage 16 which communicate with paint mixture reservoir 18 disposed at the interior of body 12. End 22 of the squeegee contains two parallel spaced apart wipers 24 and 26.

Located at each end of the wipers 24, 26, are dams 30 which substantially enclose the ends of the wipers and form the end boundaries of the paint reservoir 18. The paint mixture reservoir 18 comprises an area surrounded by the interior longitudinal sides of the wipers 24, 26 and the dams 30. Each of the wipers 24, 26 has an inner surface 34 and an outer surface 36. It has been determined that substantial amounts of paint have been wasted because (1) too much paint flows through the squeegee and (2) paint flows outside the area between the wiper blades to closed areas on the screen adjacent the pattern, where the paste is not used and dried thereon. It is an important feature of this invention that the squeegee of the present invention has solved both of these problems by substantially reducing the flow of the paint through the squeegee and then maintaining the paint in the area bounded by the two wiper edges. This is accomplished first of all by having a single narrow feed passage 16 which restricts the amount of paint flowing into the paint mixture reservoir 18. It has been found that far more paint had been allowed to flow through a squeegee then was possibly needed for the screening operation. Second, the angles of the inner and outer faces of the wipers are critical for maintaining the paint mixture in the area between the two wiper blade edges 38, shown as "A" on FIG. 1. It is critical that the angle of the inner surface 34, that is the angle between an inner surface and a plane parallel to the longitudinal axes of the wiper blade edges 38, be twice the angle between the outer surface and the aforedescribed plane. For example, the angle of the inner surface may be 30° as shown on FIG. 1, while the angle of the outer surface comprises 15°. This arrangement of angles serves to maintain the paint within the width "A" at length "B" (FIG. 2) and substantially reduces the outflow of the paint mixture beyond the wiper blade edges 38.

Figure 3:
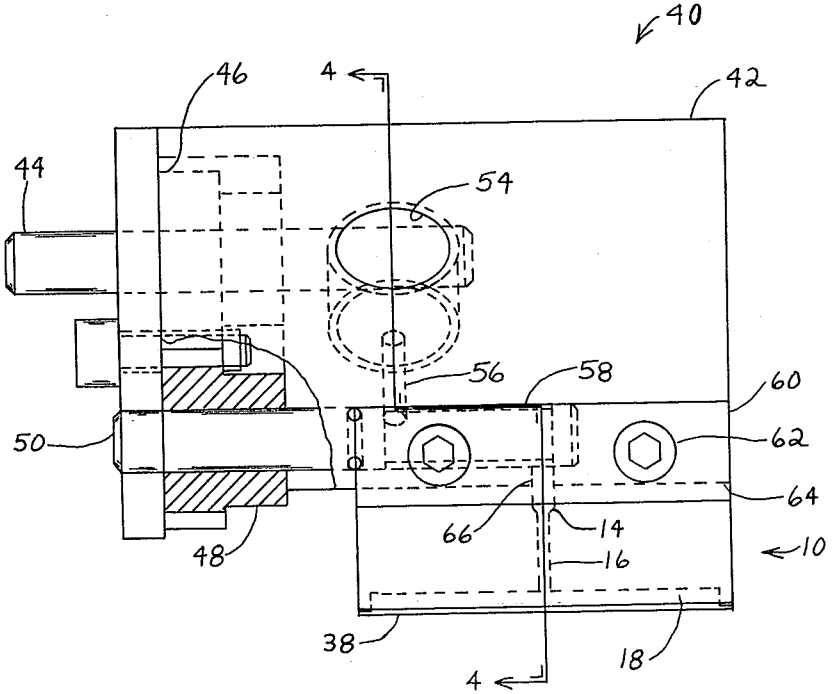
FIG. 3 is a partially cut-away side view of the paint mixer having the squeegee mounted thereon.

Referring now to FIGS. 3 and 4, there is shown the mixing unit referenced generally by numeral 40. The mixing unit comprises a head 42, a drive shaft 44, gears 46 and 48, and mixing shaft 50. The head 42 is a metal cast unit having feed line openings 54 communicating with feed shafts 56 leading to mixing cylinder 58.

Mounted about the bottom portion of the head 42 are squeegee holders 60, each secured to the head 42 by bolts 62. The squeegee holders 60 mount and secure the squeegee body 12 to the bottom face 64 of the head 42, so that the feed aperture 14 communicates with feed aperture 66 located at the bottom of the mixing cylinder 58. Thus, the flow of paint mixture is into the feed line openings 54, the feed shafts 56, the mixing cylinder 58, to the feed aperture 14, the feed passage 16, and finally the reservoir 18 for dispensing in the area "A"–"B" disposed between the wiper blade edges 38.

The drive shaft 44 is driven through a flexible shaft 45 by an independently controllable variable speed motor 70 (See FIG. 5) connected to the drive shaft 44. The drive shaft 44 is connected via gears 46 and 48 to mixing shaft 50. The clearance between the mixing shaft 50 and mixing cylinder 58 is 0.020 inches and the mixing shaft may be rotated at speeds from 60 to 200 rpm. The close clearance between the mixing shaft and the mixing cylinder effects a shearing of the paints being blended, the particles of one paint being thoroughly dispersed among the particles of the other, and then the mixture is pumped through the feed aperture 66 to the squeegee for screening onto a substrate disposed on the opposite side of the screen.

It should be understood that the mixing unit is mounted in and is part of an automatic screening machine 210 (FIG. 5) which screens resistive paint mixture upon substrates 212 being moved along below a screen 214 having a pattern 216 through which the paint mixture passes onto the substrate to form printed films 215.

It is an important feature of the present invention that the paint mixture being supplied to the squeegee is supplied via a positive pumping action. That is, the paints are not moved through the device by air pressure but are pumped at closely controlled flow rates by independently operable pumps to the mixing head 42, through the mixing head and squeegee, and onto the screen.

Figure 5:
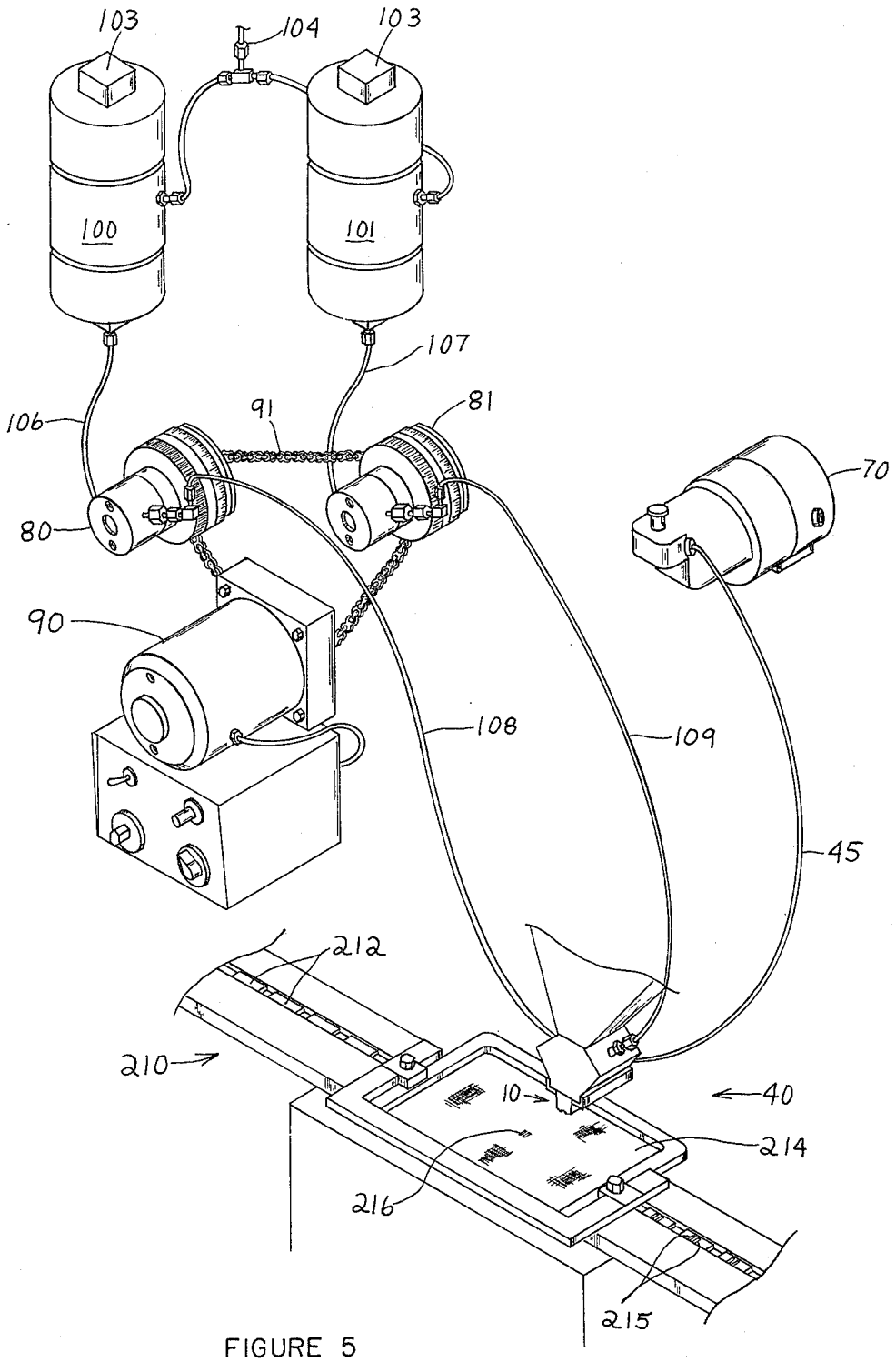
FIG. 5 illustrates the independently operable pump system and screening apparatus.

Referring now to FIG. 5, two paint pumps 80 and 81 are commonly driven by variable speed motor 90, through an endless chain 91. Each of the paint pumps is connected to a respectively associated paint reservoir, pump 80 being connected to high resistance paint reservoir 100 and pump 81 being connected to low resistance paint reservoir 101. Each of the reservoirs 100 and 101 has a plug 103 which may be removed in order to fill the reservoir with paint. An air line 104 supplies a constant pressure air supply at 10 pounds per square inch to each of the reservoirs 100, 101. High resistance paint reservoir 100 is connected via line 106 to paint pump 80 and low resistance paint reservoir is connected via line 107 to paint pump 81, the paint pumps each having a connecting line 108, 109, respectively, to the mixing unit 40.

Each of the paint pumps 80, 81 has a ceramic piston and cylinder able to withstand the abrasives in the resistance paint. These pumps can pump resistance paints at a volume as low as 0.00025 ml/stroke. Also, each pump may be individually adjusted to vary the amount of resistance paint being pumped. Such pumps may be obtained from FMI (Fluid-Metering-Inc.), Box 507, Oyster Bay, New York 11771. Thus, the resistance materials, both the high resistivity paint and the low resistivity paint, are pressure fed from the respective reservoir to the associated paint pump which then transmits the respective resistive material at a preset volumetric flow rate to the mixing unit. Each paint pump may be adjusted to vary the volumetric flow rate and, therefore, vary the ratio of the resistive paints being supplied to the mixing unit, which correspondingly changes the resistivity of the mixture being blended by the mixing unit. For example, if a production run requires a mixture having a higher resistivity than the mixture being screened, then the paint pump 80 may be adjusted to pump at a higher volumetric rate while the paint pump 81 is adjusted to pump at a lower volumetric rate, thereby supplying different amounts of resistive materials to the mixing unit which will then blend and supply to the squeegee a mixture comprised of more high resistive material and less low resistive material.

Additionally, the variable speed motor 90 which drives both of the paint pumps 80, 81, may be adjusted so that the total amount of paint being supplied to the mixing unit 40 and squeegee 10 may be increased or decreased, without altering the ratio of the paints being supplied to the mixing unit. Thus, if the screening operation is to be speeded up, the variable speed motor 90 may be set at a higher speed setting which will then cause greater amounts of high and low resistive paints to be pumped by the paint pumps, at the same ratio, to the mixing unit and through the squeegee. Of course, the speed of motor 70 driving the mixing shaft 50 will be increased correspondingly so that the mixing unit can operate at the higher volumetric flow rate.

Referring now to FIG. 6, there is illustrated a closed-loop feedback network wherein a first resistive paint mixture is screened onto an insulatine substrate to form a first printed film, the printed film is dried and then a second resistive paint mixture is screened onto the substrate to form a second printed film, the films are fired, the resistance values of the respective fired resistors determined and then utilized to effect changes in the respective mixtures being screened. The thick film substrates 130 are fed into the screener assembly No. 1 wherein resistive paints pumped from a low resistance paint reservoir (101) and a high resistance paint reservoir (100) are blended by a mixing unit (40) and then applied to each of the substrates. The substrates 130 then pass through a dryer 140 so that the screened on resistive mixture or film will not smear when each substrate moves through the screener assembly No. 2. At the second screener assembly, paints from another set of low (101) and high (100) resistance paint reservoirs are again pumped to a mixing unit (40) and then screened onto the substrates. The printed films comprising a resistor network then pass through a kiln or furnace 160 and are fired. After leaving the furnace 160, the fired resistor networks 170 are submitted to a resistance measuring device 180 which reads the resistances of the individual fired resistors in the network, and communicates the measured resistance values to a computer 190. The computer 190 compares the fired resistance values with preset standard resistance values selected for the networks of the particular production run. The computer determines the deviations, if any, from the standard resistance values and then communicates corrective signals via lines 191 and 192 to paint mix ratio controls 201 and 202, respectively. Each paint mix ratio control is connected to and controls its respective screener assembly. Paint mix ratio control 201 will alter or change the mixture ratio of the resistance material being screened onto the substrates by screener assembly No. 1. This change will be effected by the control 201 altering the flow settings of the pumps 80 and 81. The paint mixture ratio control will either increase or decrease the amount of high resistance paint material being pumped by pump 80 and correspondingly increase or decrease the amount of low resistance material being pumped by paint pump 81, thus altering the ratio of paints in the mixture and thereby effecting a change in the resistivity of mixture which will, according to predetermined mixture ratios, produce a corresponding change is the ultimate fired resistance value. In the same manner, paint mixture ratio control 202 will correct the volumetric flow rates of the respective high and low resistive paint pumps for screener assembly No. 2, thereby varying the ratio of the paints in the mixture and the finally obtained fired resistance values.

Thus, by continuously monitoring through the closed-loop feedback network the fired resistor values and analyzing the deviations therefrom, and communicating corrections to the respective paint mix ratio controls to correspondingly change the volumetric flow rates of the high and low resistivity paints, it is possible to achieve and control the optimum target values of the paint blends, and thus utilize a major tool in obtaining yields and controlling fired resistor parameters. As previously described, such parameters include fired resistance values, long-term stability, temperature coefficient of resistivity, and temperature coefficient resistivity tracking values.

Another improvement is trimming time which is obviously reduced by the attainment of fired resistor values closer to or equaling the preselected standard resistance values of the production run. The apparatus and method of manufacturing fired resistor networks of the present invention enables the manufacturer to effect "in-process" or "on-line" paint mixture changes by alteration of the individual volumetric pumping rates of the pumps. This can reduce the change over time between production runs to five minutes or less, thereby resulting in greater yields because a screening machine experiences less downtime. Additionally, more consistent results are obtained by the continuous monitoring of the fired resistance values via the closed-loop feedback network. The implementation of "on-line" paint mixture changes allows close monitoring of the mixture or blend being screened upon a substrate, and eliminates the need for large paint inventories of various standard premixed blends from which a particular blend must be selected for producing a particular fired resistor. Now a manufacturer may maintain simply a stock of high and low resistance paints to be utilized for filling the respective reservoirs on the screening machines.

The squeegee developed for use with the screening machine also results in an additional savings through efficient use of the resistive paint mixture. The squeegee, by having the inner and outer surfaces of the wiper blades disposed in the given critical angle relationship, maintains the resistance mixture within the area between the wiper blade edges and thereby reduces the amount of resistance paint mixture flowing beyond the wipers onto areas of the screen where it does not pass through the pattern of the screen. The mixture material would remain on the areas adjacent the pattern of the screen, and would dry and result in a waste of the paint mixture.

Additionally, it has been found that paint mixtures can be efficiently utilized and waste minimized by controlling the amount of resistance mixture being pumped into and through the squeegee. The squeegees currently being used on screening machines are structured to permit a large flow of resistance mixture through the squeegee. It has been found that the amount of resistance mixture flowing through the squeegee far exceeds the amount of paint required for the screening process. Thus, the squeegee of the present invention has been designed to have but one narrow feed passage through which resistance paint mixture passes from the mixing cylinder to the area between the squeegee blades edges. Thus, the improved control of the paint mixture volumetric flow rate coupled with the design of the squeegee, enables a more tighter control of the amount of paint mixture required for the screening operation.

Figure 7:
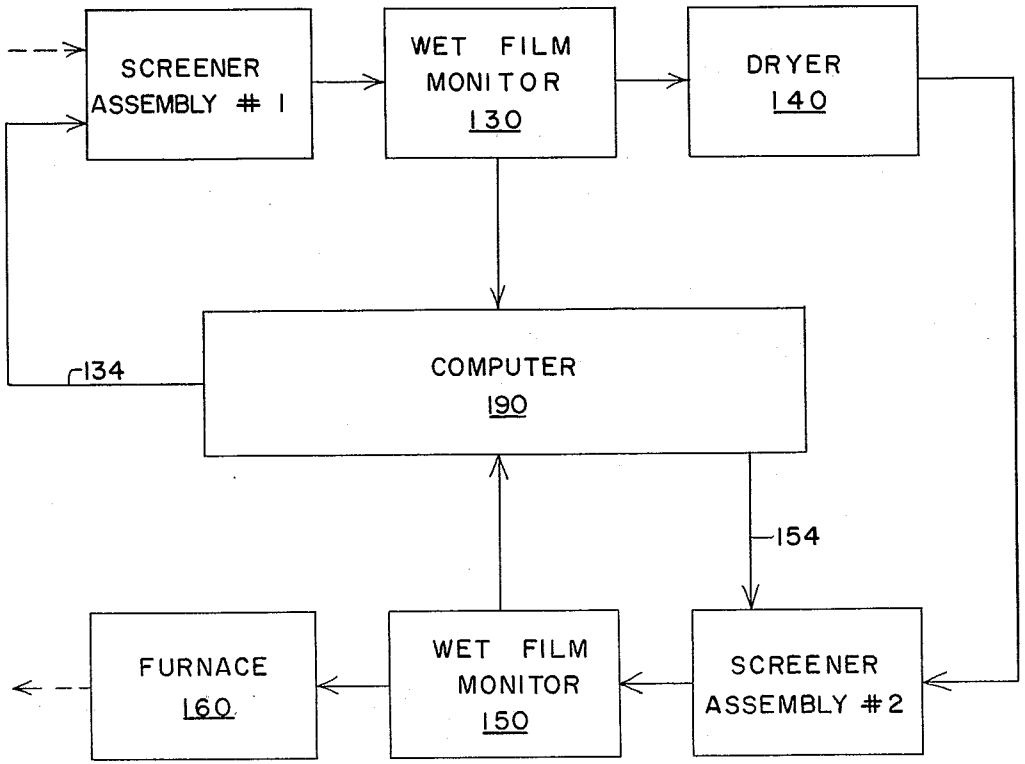

Referring now to FIG. 7, there is illustrated a flow diagram showing additional monitoring means which may be added to the flow diagram and process illustrated in FIG. 6. The additional monitoring means comprises the intermediate step of monitoring the wet film thickness, or length, or width of the screened-on resistance film. There is a correlation between the thickness of the screened-on resistance film and the final fired resistance value and temperature coefficient of resistance value. Generally speaking, the thicker the resistance film, the lower the resistance value of the final fired resistor film because of the greater amount of conductive material present within the resistance film. The physical parameter of the thickness of screened-on wet resistance films is monitored by use of a Zeiss light section microscope which provides for an effective monitoring of wet film thickness as the substrates exit the particular screening apparatus. However, such a microscope does not lend itself readily to a completely automated manufacturing process. Therefore, a laser apparatus which monitors diffracted light beams in order to determine the thickness of a screened-on wet resistance film will be utilized to provide a continuous monitoring of wet film thickness. If a deviation too far from a preselected thickness value is detected, the associated screener assembly will be adjusted to effect a predetermined film thickness.

The purpose of utilizing these additional monitoring means in conjunction with the process shown in FIG. 6, is to provide intermediate monitoring means which monitor film parameters independent of the compositional make-up of the resistance film, but which independently affect the final fired resistance value being operatively monitored for compositional correction by the computer 190. In addition, this monitoring means is intermediate the various screening steps and occurs much earlier in the entire process than the final fired resistance measuring device 180, therefore enabling a more thorough monitoring through the various steps for manufacturing the resistor networks.

As shown in FIG. 7, the substrates would pass through screener assembly No. 1 wherein a resistive film is screened thereon, as previously described, and then the substrates bearing the wet resistance films would pass through wet film monitor 130 whereinthe thickness of a wet film would be determined and such information supplied to the computer 190. The substrates would then pass through the dryer 140 for drying the wet resistive films and preventing smearing when the substrates enter screener assembly No. 2. Computer 190 would compare the wet film thickness values with a preselected standard thickness value. The computer 190 would determine if the wet film thickness values are within preselected limits and, if necessary, a signal would be sent via line 134 to screener assembly No. 1. It has been found that the thickness of a screened-on resistance film is affected by the shearing action of a screener assembly. That is, the faster the screener assembly operates (the faster the squeegee moves across the screen), the lower are the viscuous and shear forces and more resistance material passes through the screen onto the substrate, thereby resulting in a thicker screened-on resistance film. Also, the thickness of screened resistance films may be altered according to the amount of pressure exerted by the squeegee against the screen. It is well known in the art that if the squeegee head pressure (the pressure exerted against the screen) is increased, the resulting screened film will be thinner; and inversely, the lower the squeegee head pressure, the thicker the screened wet resistance film. Thus, if the measured wet resistance film thicknesses are beyond acceptable limits preestablished and set in computer 190, the computer 190 will deliver a corrective signal via line 134 to screener assembly No. 1 which will then speed up or slow down the screener assembly according to the correction needed, or if a different adjustment technique is used, the pressure of the squeegee against the screen will be increased or decreased according to the correction needed.

The substrates than pass through screener assembly No. 2 and, in the manner previously described, the thickness of the second resistance films are determined by wet film monitor 150, the information being supplied to the computer 190 for a corrective signal, if needed, supplied via line 154 to screener assembly No. 2. Thus, the thickness of the screened-on wet resistance film can be continuously monitored in order to determine whether the respective screener assembly is operating appropriately. The significance of these intermediate monitoring means, is that an improper screened-on film thickness can lead to a different final fired resistance value, which is subsequently read by the resistance measuring device 180 and supplied to the computer 190, which would then, through the respective paint mix ratio control, alter the resistance composition to correct for the incorrect fired resistance value, even though the original resistance mixture may have been correct. Thus, the additional monitoring means eliminates a possible structural deviation and enables a more accurate monitoring of final fired resistance values in order to increase yields and control the fired resistor parameters as previously described.

Industrial Applicability

The present invention has applicability in the electronic component manufacturing industry. The invention may be utilized in manufacturing processes whereby a resistive paint or paints are screened onto insulative substrates, the resistive paint then fired to produce individual resistors or resistor networks.

Conclusion

It is reasonably to be expected that those skilled in the art can make numerous revisions and adaptations of the invention and it is intended that such revisions and adaptations will be included within the scope of the following claims as equivalents of the invention.

We claim:

1. A process for producing uniform resistors, comprising the steps of supplying substrates to a means for screening a resistive mixture thereon, said screening means comprising a means for mixing at least two resistive materials and supplying said mixture to a squeegee attached thereto, mixing said resistive materials and screening the mixture onto said substrates, firing said screened mixture to form resistors, detecting the resistance values of said fired resistors, comparing each of said resistance values to a standard resistance value and determining the deviation therefrom, adjusting the amount of each of said resistive materials supplied to said means for mixing to correct the ratio of the resistive materials in said mixture, and continuously monitoring and controlling the mixture ratio of said resistance materials by continuous comparison of the resistance values of said fired resistors with said standard resistance value.

2. The process in accordance with claim 1, further comprising the step of varying the volumetric flow rate of said resistive mixture supplied to said squeegee.

3. The process in accordance with claim 1, further comprising the step of varying the combined volume of said resistive materials supplied to said mixing means.

4. The process in accordance with claim 1, further comprising the step of maintaining said resistive mixture within the interior of said squeegee, the interior defined by the area between parallel longitudinal wipers having dams disposed transversely at the ends thereof.

5. The process in accordance with claim 4, wherein each of said wipers has an inner and an outer surface, said inner surface disposed at an angle with a plane parallel to the longitudinal axes of said wipers that is at least twice the angle between the outer surface and said plane.

6. The process in accordance with claim 1, further comprising the steps of measuring the thickness of the screened mixtures, comparing each thickness value to a standard thickness value and determining the deviation therefrom, adjusting the screening means to maintain a predetermined thickness for the screened mixture, and continuously monitoring and controlling the thickness of said screened mixture by continuous comparison of the thickness values of said screened mixture with said standard thickness value.

7. A process for manufacturing resistor networks, comprising the steps of supplying substrates to a first means for applying a resistive mixture thereon, said first applying means comprising a means for mixing at least two resistive materials and supplying said mixture to a squeegee for applying said mixture onto said substrates, mixing said resistive materials and applying said mixture onto said substrates, drying said resistive mixture, supplying at least two resistance materials to a second means for applying a second resistive mixture onto said substrates, said second applying means comprising a means for mixing said resistance materials and supplying said second mixture to a second squeegee, mixing said resistance materials and applying said second mixture onto said substrates, firing said applied mixtures to form resistors on said substrates, detecting the resistance values of said resistors, comparing said resistance values with standard resistance values and determining the deviations therefrom, adjusting the respective amounts of each of the materials supplied to the first and second applying means to correct the ratios of the respective materials in said mixtures, and continuously controlling the mixture ratios of the materials supplied to the first and second applying means through a closed-loop feedback network.

8. The process in accordance with claim 7, further comprising the step of varying the flow rate of the respective mixtures being supplied to the squeegees.

9. The process in accordance with claim 7, including the step of varying the respective combined amounts of resistive materials and resistance materials being supplied to the respective mixing means.

10. The process in accordance with claim 7, further comprising the steps of measuring the thickness of said applied resistive mixture, measuring the thickness of the applied second mixture, comparing the respective thickness values to respective standard thickness values and determining the deviations therefrom, and continuously adjusting each respective means for applying a mixture to maintain a predetermined thickness for the respectively applied mixture.

11. A process for blending resistive materials and applying said blend onto substrates, comprising the steps of continuously supplying substrates to a means for applying said blend of resistive materials to said substrates, said applying means including a means for mixing at least two resistive materials, supplying at least two resistive materials to the means for mixing said resistive materials, mixing said resistive materials to disperse one material in another, and applying the mixture onto each of said substrates.

12. The process in accordance with claim 11, further comprising the step of metering each resistive material at predetermined flow rates to said mixing means.

13. The process in accordance with claim 11, further comprising the step of operating said means for mixing said resistive materials at variable speeds.

14. The process in accordance with claim 11, wherein the means for mixing said resistive materials comprises a blending head having an opening and a rotating shaft disposed in said opening, whereby said resistive materials are blended between said shaft and the surface of said opening.

15. The process in accordance with claim 11, wherein the applying means includes a squeegee having two longitudinal wipers and dams disposed at the ends of said wipers, each wiper having an inner surface and an outer surface.

16. The process in accordance with claim 13, wherein said inner surface is disposed at an angle with a plane parallel to the longitudinal axes of said wipers that is at least twice the angle between said outer surface and said plane.

17. The process in accordance with claim 15, including the step of transmitting said mixed resistive materials through an opening passing through said squeegee.

18. A process for producing a fired resistor, comprising the steps of: continuously supplying substrates to a means for applying a resistance mixture to said substrates, said applying means including a means for mixing at least two substantially variant resistance materials, supplying from independent sources at least two substantially variant resistance materials, mixing such materials to effect a substantially homogenous resistance mixture for providing a resistance value of a predetermined amount, applying said mixture to a substrate, firing said applied mixture, measuring the resistance value derived from the fired resistance mixture and determining the deviation from said predetermined value, and continuously adjusting the relative proportions of said materials to maintain the predetermined value.

19. The process in accordance with claim 11 or 18, further comprising the steps of measuring the thickness of an applied mixture, comparing the thickness value to a standard thickness value and determining the deviation therefrom, and adjusting the applying means to maintain a predetermined thickness for subsequently applied mixtures.

20. A process for producing resistor networks, comprising the steps of: supplying a substrate to first and second means for applying resistance mixtures to said substrate, said first and second applying means including respective means for mixing at least two variant resistance materials, supplying from separate first sources at least two variant resistance materials, mixing the first materials to effect a first resistance mixture for providing a first resistance value of predetermined amount, said first applying means applying said first mixture of said substrate, supplying from separate second sources at least two variant resistance materials, mixing the second materials to effect a second resistance mixture for providing a second resistance value of a predetermined amount, said second applying means applying said second mixture to said substrate, firing said applied mixtures, measuring the first and second resistance values derived from the respective fired mixtures and determining the deviations from the respective predetermined values, and continuously adjusting the proportions of said respective resistive mixtures to maintain predetermined resistance values of the first and second fired mixtures.

21. The process in accordance with claim 20, further comprising the steps of measuring the thickness of the respective first and second applied mixtures, comparing the respective thickness values to respective standard thickness values and determining the deviations therefrom, and continuously adjusting the respective applying means to maintain a predetermined thickness for the respectively applied mixture.

* * * * *

UNITED STATES PATENT OFFICE

CERTIFICATE OF CORRECTION

Patent No. 4,338,351 Dated July 6, 1982

Inventor(s) Terry R. Bloom; Marion E. Ellis

It is certified that error appears in the above-identified patent and that said Letters Patent are hereby corrected as shown below:

Column 6, line 46 - delete "insulatine" and insert --insulative--

Column 11, claim 16, line 58 - delete "13" and insert --15--

Signed and Sealed this

Nineteenth Day of April 1983

[SEAL]

*Attest:*

GERALD J. MOSSINGHOFF

*Attesting Officer*

*Commissioner of Patents and Trademarks*